US007057382B2

(12) United States Patent
Sigurdardottir

(10) Patent No.: US 7,057,382 B2
(45) Date of Patent: Jun. 6, 2006

(54) VOLTAGE REFERENCE CIRCUIT

(75) Inventor: Anna Sigurdardottir, Wokingham (GB)

(73) Assignee: STMicroelectronics Limited (GB)

( * ) Notice: Subject to any disclaimer, the term of this patent is extended or adjusted under 35 U.S.C. 154(b) by 88 days.

(21) Appl. No.: 10/896,362

(22) Filed: Jul. 21, 2004

(65) Prior Publication Data

US 2005/0040805 A1 Feb. 24, 2005

(30) Foreign Application Priority Data

Jul. 22, 2003 (EP) ..... 03254576

(51) Int. Cl.
*G05F 3/16* (2006.01)
*G05F 3/20* (2006.01)

(52) U.S. Cl. ..... 323/313; 323/316; 327/538

(58) Field of Classification Search ..... 323/313, 323/314, 316; 327/538, 537
See application file for complete search history.

(56) References Cited

U.S. PATENT DOCUMENTS

| | | | | |
|---|---|---|---|---|
| 5,146,152 | A * | 9/1992 | Jin et al. | 323/280 |
| 5,220,273 | A | 6/1993 | Mao | |
| 5,281,906 | A | 1/1994 | Thelen, Jr. | |
| 5,369,354 | A * | 11/1994 | Mori | 323/313 |
| 5,448,159 | A * | 9/1995 | Kojima et al. | 323/315 |
| 6,683,445 | B1 * | 1/2004 | Park | 323/315 |
| 6,710,586 | B1 * | 3/2004 | Yamamoto | 323/313 |

FOREIGN PATENT DOCUMENTS

EP 0 0 915 407 A 5/1999

* cited by examiner

*Primary Examiner*—Bao Q. Vu
(74) *Attorney, Agent, or Firm*—William A. Munck

(57) ABSTRACT

A voltage reference circuit comprising a first reference voltage source, a second reference voltage source, at least one of said first and second reference voltage sources being dependent on temperature, and first circuitry connected to at least one of said first and second reference voltage sources to provide a third reference voltage, said third reference voltage being dependent on temperature.

23 Claims, 4 Drawing Sheets

VOLTAGE REFERENCE CIRCUIT

FIELD OF THE INVENTION

The present invention relates to a voltage reference circuit and in particularly but not exclusively to voltage reference circuits for incorporation within integrated circuits.

BACKGROUND OF THE INVENTION

Reference voltages are used within the field of electronics in a large number of situations. They can be used for instance in a comparator to produce a known value against which another value can be compared.

Often in complex circuitry more than one voltage reference value is required. It is known in the art that a range of different value references can be created using circuitry as simple as a potential divider. A potential divider receives a first voltage and produces a second voltage or further voltages, the second or further voltages being a fraction of the first voltage dependent on the values of the potential divider network.

Furthermore, dependent on the components used in the voltage reference circuit each voltage reference has a temperature coefficient value which defines the change of the voltage reference value dependent on temperature. The temperature coefficient value may be positive, negative or zero. In other words the reference voltage value increases with, decreases with or is independent of the temperature.

Complex circuits can require a series of different voltage reference values each of which have a different voltage temperature coefficient.

In such a situation a circuit that generates a single voltage reference which is then divided using a potential divider cannot be used, as the voltage sources generated by such a circuit would have temperature characteristics divided in the same ratio as the potential divider voltage. Thus no one network could produce a range of voltage and temperature coefficient values other than those whereby the voltage and coefficient values were directly related.

Therefore there exists no single circuit whereby a series of voltage reference values with programmable voltage values and programmable temperature coefficients are provided, without the reference voltages being created individually.

SUMMARY OF THE INVENTION

To address the above-discussed deficiencies of the prior art, it is the aim of the embodiments of the present invention to provide address or at least mitigate the problems described above.

There is provided according to the present invention a programmable voltage reference circuit comprising: a first reference voltage source; a second reference voltage source, at least one of said first and second reference voltage sources being dependent on temperature; and first circuitry connected to at least one of said first and second reference voltage sources to provide a third reference voltage, said third reference voltage being dependent on temperature.

There may further comprise second circuitry connected to at least one of said first and second reference voltage sources to provide a fourth reference voltage, said fourth reference voltage being dependent on temperature.

Preferably at least one reference voltage source may be directly proportional to temperature.

Preferably at least one reference voltage source may be inversely proportional to temperature.

The second circuitry may comprise: a first input; a second input; and an output, wherein said first input may be connected to said third reference voltage, said second input may be connected to said first reference voltage source and said output may provide said fourth voltage source.

The second circuitry may further comprise: a first gain stage; and a differential amplifier, wherein said differential amplifier may be configured to receive the output of the first gain stage and the first input and may output a value to the output of said second circuitry.

The second circuitry may further comprise a second gain stage, wherein said differential amplifier may be configured to receive at a second input the output of the second gain stage.

The first circuitry may comprise: a first input; a second input; an output, wherein said first input may be connected to said first reference voltage source, said second input may be connected to said second reference voltage source and wherein said output may provide said third reference voltage.

The first circuitry may further comprise a first gain stage; and a differential amplifier, wherein said differential amplifier may be configured to receive at a first input the output of the said first gain stage and may output a value to the output of said first circuitry.

The first circuitry may further comprise a second gain stage, wherein said differential amplifier may be configured to receive at a second input the output of the second gain stage.

The third reference voltage temperature dependency may be different from said first and second reference voltage temperature dependency.

The fourth reference voltage temperature dependency may be different from said first and second reference voltage temperature dependency.

The third reference voltage temperature dependency may be different from said fourth reference voltage temperature dependency.

The first reference voltage source may be independent of temperature.

The third reference voltage temperature dependency may be one of a positive or negative temperature dependency.

The fourth reference voltage temperature dependency may be one of a positive or negative temperature dependency.

The third reference voltage may be dependent on at least one of: said first reference voltage; said second reference voltage; and said first circuitry.

The fourth reference voltage may be dependent on at least one of: said first reference voltage; said third reference voltage; and said second circuitry.

An integrated circuit may comprise a circuit as detailed previously.

According to a second aspect of the present invention there is provided a method for providing programmable reference voltages comprising the steps of: providing a first reference voltage; providing a second reference voltage at least one of which being dependent on temperature; and providing a third reference voltage from a first circuitry connected to at least one of said first and second reference voltage sources, said third reference voltage being dependent on temperature.

The method may further comprise the step of providing a fourth reference voltage from a second circuitry connected to at least one of said first and second reference voltage sources, said fourth reference voltage being dependent on temperature.

Before undertaking the DETAILED DESCRIPTION OF THE INVENTION below, it may be advantageous to set forth definitions of certain words and phrases used throughout this patent document; the terms "include" and "comprise," as well as derivatives thereof, mean inclusion without limitation; the term "or," is inclusive, meaning and/or; and the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to our with, have, have a property of, or the like. It should be noted that the functionality associated with any particular apparatus or controller may be centralized or distributed, whether locally or remotely. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a better understanding of the present invention and how the same may be carried into effect, reference will now be made by way of example only to the accompanying drawings, in which like reference numerals represent like parts, and in which.

DETAILED DESCRIPTION OF THE INVENTION

FIGS. 1 through 3*b*, discussed below, and the various embodiments used to describe the principles of the present invention in this patent document are by way of illustration only and should not be construed in any way to limit the scope of the invention. Those skilled in the art will understand that the principles of the present invention may be implemented in any suitably arranged circuit or system using a voltage reference circuit.

Figure 1:
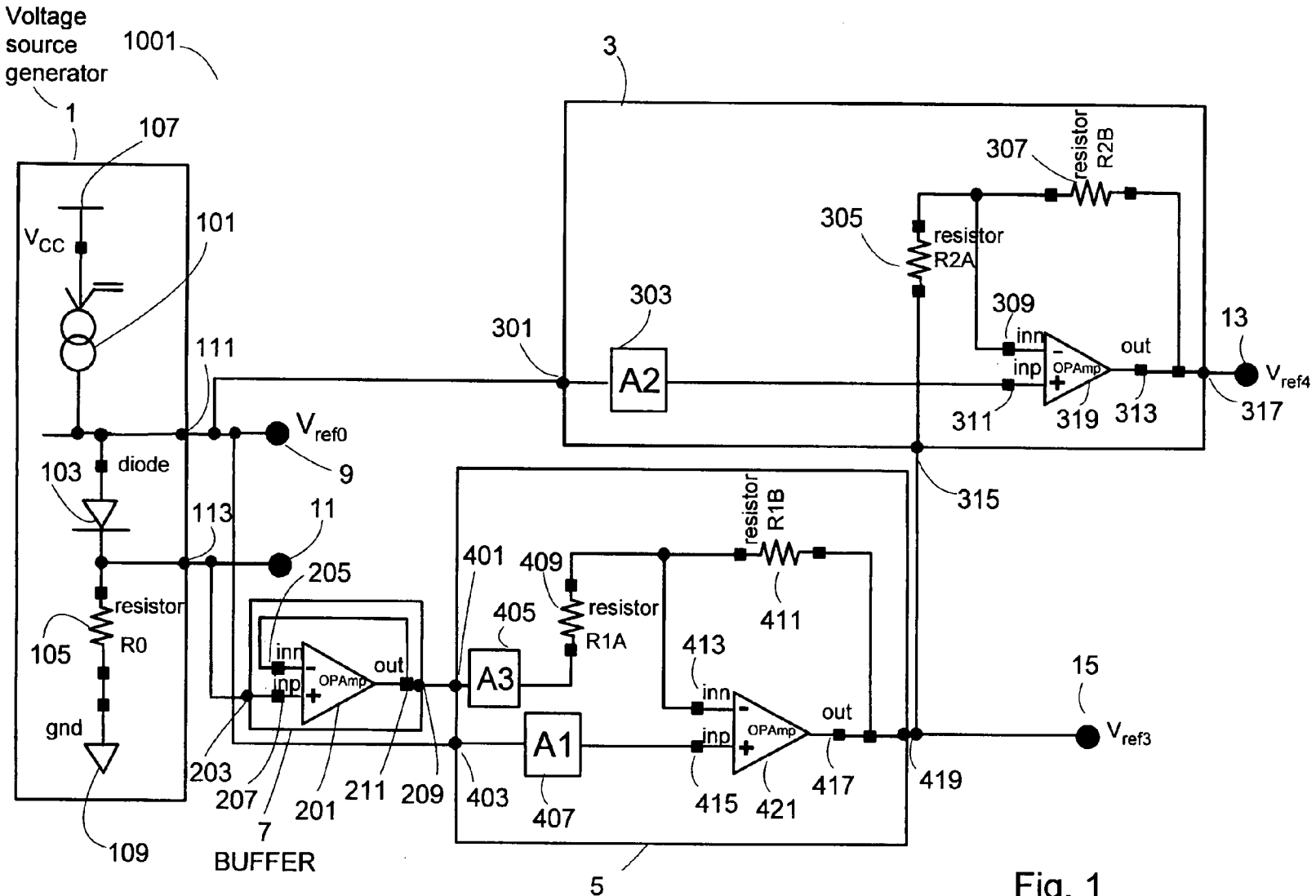
FIG. 1 shows a schematic view of a voltage reference circuit with programmable voltage values and temperature coefficients incorporating an embodiment of the present invention.

Reference is made to FIG. 1, which shows a first embodiment of the present invention.

The programmable voltage reference circuit 1001 comprises a voltage source generator 1, a first temperature coefficient voltage source 5, a second temperature coefficient voltage source 3, a voltage buffer 7, a first reference voltage output ($V_{ref0}$) 9, a second reference voltage output ($V_{ptat}$) 11, a third reference voltage output ($V_{ref1_NTC}$) 15 and a fourth reference voltage output ($V_{ref2_PTC}$) 13.

In some embodiments of the present invention the first reference voltage output and second reference voltage output are internally used outputs only and are not connected to external pins to be used outside of the circuit. In other embodiments of the present invention the first and second reference voltage outputs $V_{ref0}$ and $V_{ptat}$ are buffered and output external to the circuit.

The voltage source generator (VSG) 1 comprises a first output 111 and a second output 113. The first output 111 is connected to the first reference voltage output 9. The second output 113 is connected to the second reference voltage output 11.

The buffer 7 comprises a buffer input 203 and a buffer output 209. The buffer input 203 is connected to the second reference voltage output 11.

The first temperature coefficient voltage source 5 comprises a first input 401, a second input 403 and a voltage source output 419. The buffer output 209 is connected to the first input 401 of the first temperature coefficient voltage source 5. The second input 403 of the first temperature coefficient voltage source 5 is connected to the first reference voltage output 9. The voltage source output 419 of the first temperature coefficient voltage source 5 is connected to the fourth reference voltage output 15 ($V_{ref3}$).

The first temperature coefficient voltage source 5 is therefore designed to produce a desired reference voltage, with a desired temperature coefficient from two input voltages which do not have the required values.

The second temperature coefficient voltage source 3 comprises a first input 315, a second input 301, and a voltage source output 317.

The voltage source output 419 of the first temperature coefficient voltage source 5 is connected to the first input 315 of the second temperature coefficient voltage source 3. The second input 301 of the second temperature coefficient voltage source 3 is connected to the first reference voltage output 9 ($V_{ref0}$). The voltage source output 317 of the second temperature coefficient voltage source 3 is connected to the third reference voltage output 13 ($V_{ref4}$).

The second temperature coefficient voltage source 3 is therefore designed to produce a desired reference voltage, with a desired temperature coefficient from two input voltages which do not have the required values.

The voltage source generator further comprises a first voltage source 107 ($V_{cc}$), a second voltage source 109 (GND), a first current source 101, a diode 103 ($D_1$), and a resistor 105 ($R_0$).

The first voltage source 107 is connected to a first end of the first current source 101. The second end of the first current source 101 is connected to the anode of the diode 103. The cathode of the diode is connected to the first end of the first resistor 105. The second end of the first resistor 105 is connected to the second voltage source 109. The first output 111 is connected to the anode of the diode 103, and the second output 113 is connected to the cathode of the diode 103.

The voltage source generator defines a first reference voltage value at the first output 111 ($V_{ref0}$). The first reference voltage has a temperature coefficient substantially equal to zero for the temperature range being considered. In other words the voltage produced at the output 111 is substantially constant and independent of the ambient temperature surrounding the circuit. This substantial independence is achieved by matching the diode's negative temperature coefficient with the resistor's positive temperature coefficient over the temperature range being considered.

The voltage source generator defines a second reference voltage at the second output 113. The second reference voltage ($V_{ptat}$) has a temperature coefficient which is proportional to absolute temperature. In other words if the voltage at a temperature $T_1$ is $V_{T1}$ then the voltage output at temperature $T_2$ is:

$$V_{T2} = V_{T1} + \frac{\Delta V}{\Delta T}(T_2 - T_1)$$

where:

$$\frac{\Delta V}{\Delta T}$$

is the temperature coefficient of the proportional to absolute temperature voltage source.

As can be seen in the embodiment featured, the first reference voltage $V_{ref0}$ is at a higher level than the second reference voltage $V_{ptat}$.

Further embodiments of the present invention may feature voltage source generators where the second reference voltage has a negative temperature coefficient. Other embodiments of the present invention can also feature voltage source generators where the reference voltage with a temperature coefficient of zero has a lower value than the reference voltage with a non-zero temperature coefficient.

Figure 2A:
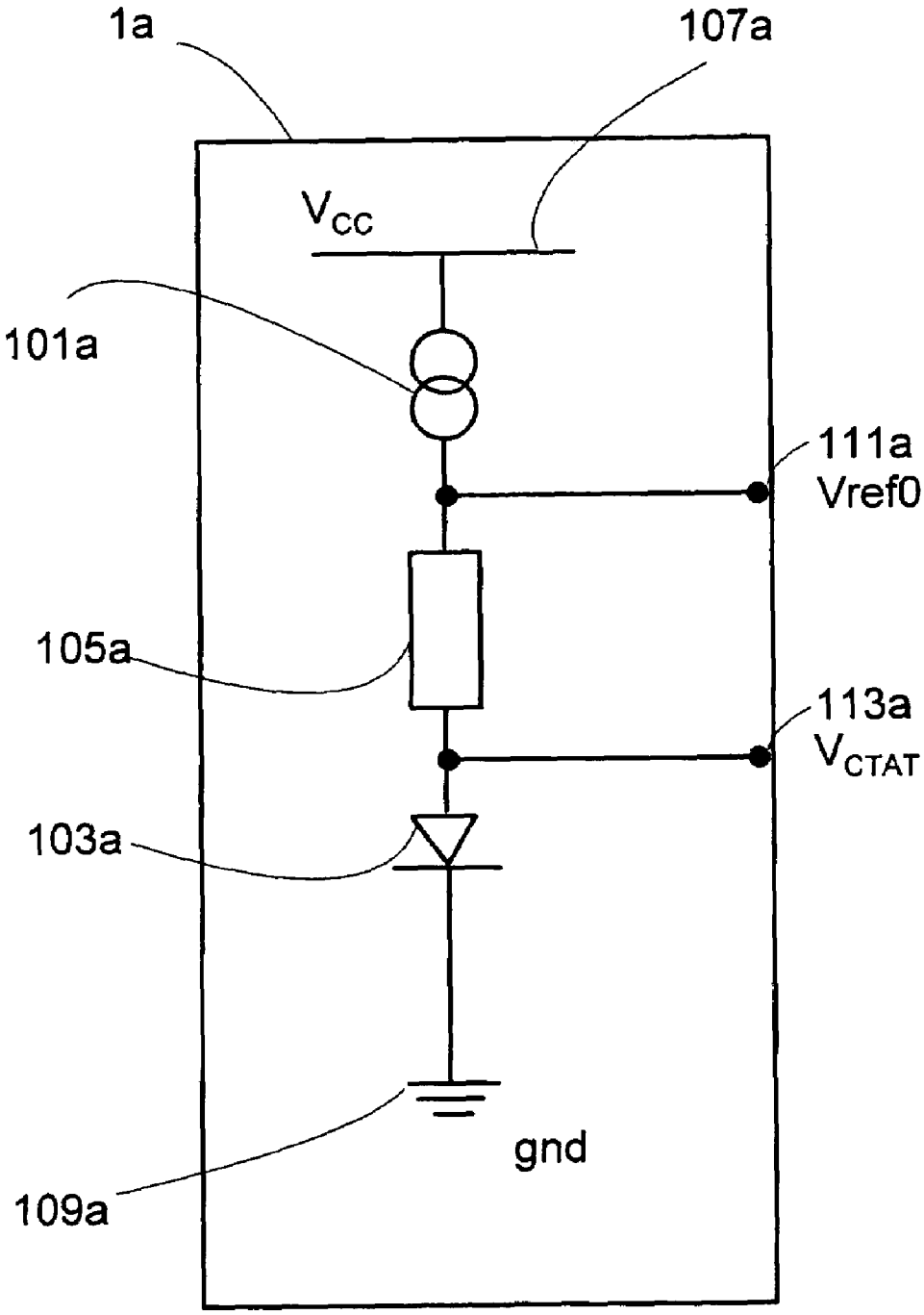
FIG. 2 shows a schematic view of three alternative fixed voltage reference sources which can be used in the arrangement of FIG. 1.

FIG. 2*a* shows one such alternative embodiment of the voltage source generator whereby the second reference voltage has a negative temperature coefficient or complimentary to absolute temperature (CTAT).

This alternative voltage source generator embodiment comprises a first voltage source 107*a* ($V_{cc}$), a second voltage source 109*a* (GND), a first current source 101*a*, a diode 103*a* ($D_1$), a resistor 105*a* ($R_0$), a first output 111*a* and a second output 113*a*.

The first voltage source 107*a* is connected to a first end of the first current source 101*a*. The second end of the first current source 101*a* is connected to the first end of the first resistor 105*a*. The second end of the first resistor 105*a* is connected to the anode of the diode 103*a*. The cathode of the diode is connected to the second voltage source 109*a*. The first output 111*a* is connected to the first end of the resistor 105*a* and the second output 113*a* is connected to the second end of the resistor 105*a*.

The voltage source generator defines a first reference voltage value at the first output 111*a* which is substantially independent of temperature, i.e. has a zero temperature coefficient $V_{ref0}$. This substantially independent source is created by choosing the negative temperature coefficient of the diode and the positive temperature coefficient of the resistor so that the two coefficients are effectively equal, and therefore cancel each other out over the required temperature range. The voltage source generator further defines a second reference voltage value at the second output 113*a* which has a negative temperature coefficient ($V_{ctat}$). The negative temperature coefficient voltage source is defined by the voltage across the diode 103*a*, which for reasons discussed earlier has a negative temperature coefficient.

Figure 2C:
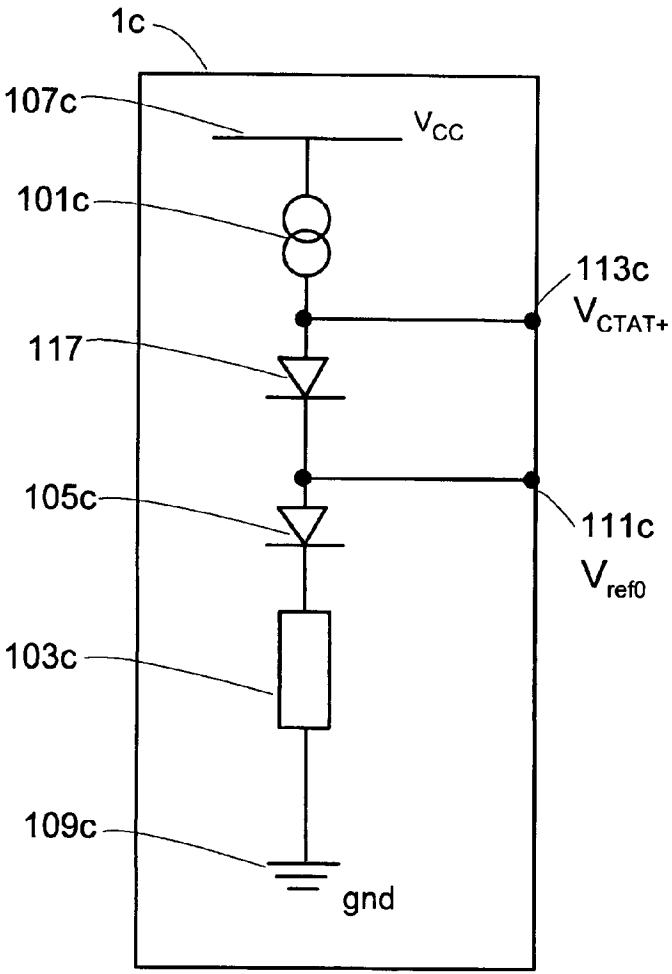
Figure 2B:
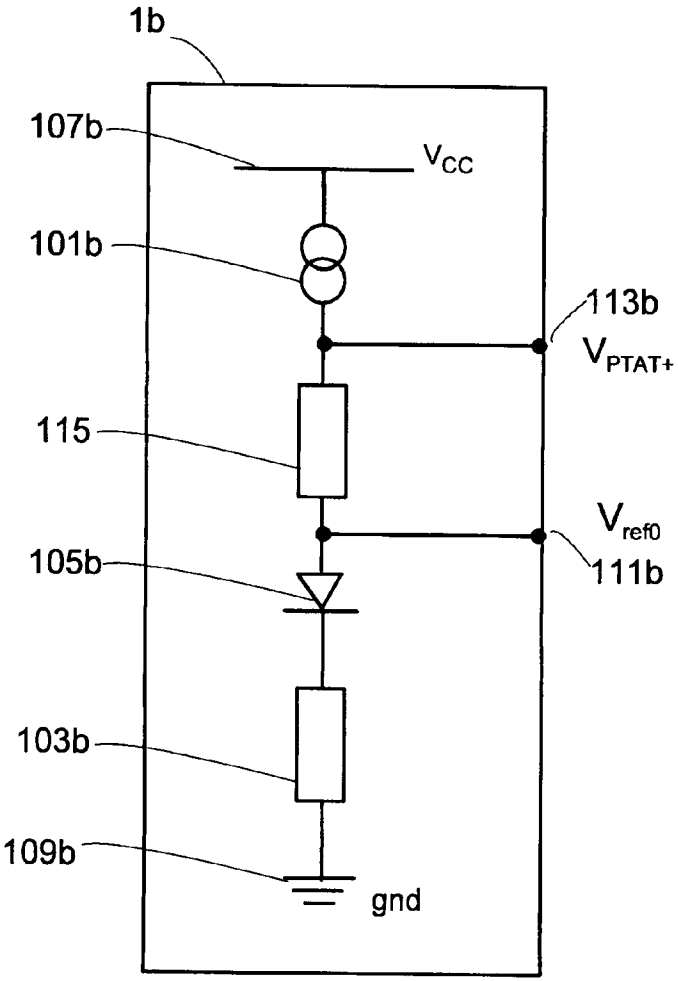

FIGS. 2*b* and 2*c* show further alternative embodiments of the voltage source generator. FIG. 2*b* comprises the first voltage source embodiment, and wherein a further resistor is inserted. A first end of a current source 101*b* is connected to a first voltage supply 107*b* (Vcc). The second end of the current source 101*b* is connected to a first end of a first resistor 115. The second end of the first resistor 115 is connected to the anode of the diode 105*b*. The cathode of the diode 105*b* is connected to one end of a second resistor 103*b*. The second end of the second resistor is connected to a second voltage source 109*b* (GND). The first output 111*b* ($V_{ref0}$) is connected to the anode of the diode 105*b*, and the second output 113*b* is connected to the junction of the current source 101*b* and the first resistor 115 ($V_{ptat+}$). In this embodiment of the present invention the reference voltage proportional to temperature is greater than the reference voltage which is substantially independent of temperature.

The first reference voltage is independent of temperature as the temperature coefficients of the diode and resistor are substantially the same but opposite over the required temperature range. The second reference voltage is proportional to temperature as the temperature coefficient of the voltage is defined by two resistor coefficients and one diode coefficient. As one resistor and diode coefficient cancel each other out over the required temperature range, the temperature coefficient is defined substantially by the temperature coefficient of the first resistor 115.

FIG. 2*c* comprises the first voltage source embodiment, wherein a further diode 117 is inserted. A first end of a current source 101*c* is connected to a first voltage supply 107*c* (Vcc). The second end of the current source 101*c* is connected to the anode of a first diode 117. The cathode of the first diode 117 is connected to the anode of a second diode 105*c*. The cathode of the second diode 105*c* is connected to one end of a second resistor 103*c*. The second end of the second resistor 103*c* is connected to a second voltage source 109*c* (GND). The first output 111*c* ($V_{ref0}$) is connected to the anode of the second diode 105*c*, and the second output 113*c* ($V_{ctat+}$) is connected to the anode of the first diode 117.

In this embodiment of the present invention the voltage reference complimentary to temperature is greater than the voltage reference which is substantially independent of temperature. The first reference voltage is independent of temperature as the temperature coefficients of the diode and resistor are substantially the same but opposite values over the required temperature range. The second reference voltage is complimentary to temperature as the temperature coefficient of the voltage is defined by two diode coefficients and one resistor coefficient. As one resistor and diode coefficient cancel each other out over the required temperature range, the temperature coefficient is defined substantially by the temperature coefficient of the first diode 117.

The buffer 7 further comprises an operational amplifier $L_3$, configured in the standard unitary gain configuration, whereby the output of the operational amplifier 211 is directly fed back to the negative input 215 of the operational amplifier. The positive input 207 of the operational amplifier is connected to the buffer input 203. The operational amplifier output 211 is further connected to the buffer output 209.

The role of the buffer is to provide a high impedance buffer to the output of the voltage source generator, so to prevent any significant current drain from the second voltage output 11 from affecting the value of the second voltage output 11 ($V_{ptat}$).

The first temperature coefficient voltage source 5 further comprises a first gain stage 407 ($A_1$), a second gain stage 405 ($A_3$), a first resistor 409 ($R_{1A}$), a second resistor 411 ($R_{1B}$) and an operational amplifier 421 ($L_1$). The first input 401 of the first temperature coefficient voltage source 5 is input to the second gain stage 405 ($A_3$). The output of the second gain stage 405 ($A_3$) is connected to the first end of the first resistor 409 ($R_{1A}$). The second end of the first resistor 409 ($R_{1A}$) is connected to the negative input 413 of the operational amplifier 421, which is also connected to the first end of the second resistor 411 ($R_{1B}$). The second end of the second resistor 411 ($R_{1B}$) is connected to the output 417 of the operational amplifier 421 and also to the output 419 of the first temperature coefficient voltage source 5. The second input 403 of the first temperature coefficient voltage source 5 is connected to the input of the first gain stage 407

($A_1$). The output of the first gain stage 407 ($A_1$) is connected to the positive input 415 of the operational amplifier 421 ($L_1$).

The configuration of the operational amplifier 421 can thus be considered to be equivalent to a differential amplifier amplifying the difference between the operational amplifiers first and second inputs, the gain of the amplifier defined by the resistors 409 and 411. Such a configuration is often called a subtracting amplifier.

The configuration of the gain stages and the operational amplifier in the described embodiment is such that the constant voltage $V_{ref0}$ is multiplied by the gain factor $A_1$ and connected to the positive input of the operation amplifier.

The second voltage, in the first embodiment $V_{ptat}$, having been buffered is multiplied by the gain factor $A_3$ and connected via the resistor $R_{1A}$ to the negative input of the amplifier. The resistor $R_{1B}$ provides a feedback route from the output to the negative input of the amplifier, which in combination with the value of the first resistor defines the operational amplification gain value.

Using circuit analysis the output 419 from the negative temperature coefficient voltage source 5 ($V_{ref3}$) at a specified (room) temperature can be described with reference to the equation 1:

$$V_{ref3} = A_1\left(1 + \frac{R_{1B}}{R_{1A}}\right)V_{ref0} - A_3\frac{R_{1B}}{R_{1A}}V_{ptat}. \quad (1)$$

Where as previously determined $A_1$ is the gain of the first gain stage 407, $A_3$ is the gain of the second gain stage 405, $R_{1B}$ is the value of the second resistor 411, $R_{1A}$ is the value of the first resistor, $V_{ref0}$ is the voltage received at the second input 403 and $V_{ptat}$ is the voltage received at the first input 401.

In order to determine the temperature coefficient of the output, the temperature coefficient of the component parts of equation 1 can be analysed. As the reference voltage $V_{ref0}$ is substantially constant (or independent) with respect to temperature the temperature coefficient of the first part of the equation is substantially zero. The temperature coefficient of the output is therefore dominated by the temperature coefficient of the voltage source $V_{ptat}$ multiplied by the second gain stage 405, $A_3$, and the ratio of the resistor network $R_{1B}$:$R_{1A}$ as can be described with reference to equation 2:

$$TC3 = \frac{dV_{ref3}}{dT} = -A_3\frac{R_{1B}}{R_{1A}}\frac{dV_{ptat}}{dT}. \quad (2)$$

Thus a desired temperature coefficient can be chosen using a combination of the gain stage $A_3$ the ratio of resistors $R_{1B}$ and $R_{1A}$ and also the temperature coefficient of the second voltage source $V_{ptat}$. This may be programmed or set as desired.

In some embodiments of the present invention the gain stage $A_3$ can be omitted, as the temperature coefficient characteristics of the output can be determined purely by the resistor network.

In further embodiments of the present invention the gain stage $A_3$ and the buffer 7 are merged and implemented as a single element.

Furthermore it may be appreciated that whilst in this embodiment the second voltage input 403 of the first temperature coefficient voltage source 5 is substantially negligible, in other embodiments the second voltage input can contribute to the temperature coefficient of the output 419 of the first temperature coefficient voltage source 5.

Having fixed the temperature coefficient for the output of the first temperature coefficient voltage source it is possible to fix the voltage reference value at a known temperature using equation 1, whereby the values of $A_1$ and $V_{ref0}$ are chosen in order to provide the required voltage value.

Thus the first temperature coefficient voltage source 5 generates a reference voltage value dependent on the two received voltage values, the ratio of the resistors, and the gain stages, and with a different voltage value and a difference temperature coefficient to both of the received voltage sources' voltage temperature coefficients.

The second temperature coefficient voltage source 3 further comprises a first gain stage 303 ($A_2$), a first resistor 305 ($R_{2A}$), a second resistor 307 ($R_{2B}$), and an operational amplifier 319.

The second input 301 of the second temperature coefficient voltage source 3 is connected to the input of the first gain stage 303 ($A_2$). The output of the first gain stage 303 is connected to the positive input 311 of the operational amplifier 319 ($L_2$). The first input 315 of the second temperature coefficient voltage source 3 is connected to a first end of the first resistor 305 ($R_{2A}$). The second end of the first resistor 305 ($R_{2A}$) is connected to the negative input 309 of the operational amplifier 319 ($L_2$). The second end of the first resistor 305 ($R_{2A}$) is also connected to a first end of the second resistor 307 ($R_{2B}$). The second end of the second resistor 307 ($R_{2B}$) is connected to the output 313 of the operational amplifier 319 ($L_2$). The second end of the second resistor 307 ($R_{2B}$) is also connected to the output 317 of the second temperature coefficient voltage source 3. Thus in a similar configuration to the operational amplifier 421 the configuration of the operational amplifier 319 can be considered to be a differential amplifier amplifying the difference between the operational amplifier's first and second inputs 309 and 311, the gain of the amplifier defined by the resistors 305 and 307.

The value of the voltage produced at the output of the second temperature coefficient voltage source 3 is determined relative to the two received voltage values $V_{ref0}$, $V_{ref3}$, the gain stage 303 ($A_2$) and the ratio of the resistor values 305,307 ($R_{2A}$, $R_{2B}$); and is defined by equation 3:

$$V_{ref4} = A_2\left(1 + \frac{R_{2B}}{R_{2A}}\right)V_{ref0} - \frac{R_{2B}}{R_{2A}}V_{ref3} \quad (3)$$

The second temperature coefficient voltage source 3 is determined in a similar manner to the determination of the temperature coefficient of the primary temperature coefficient voltage source. Once again the use of the substantially temperature independent voltage source $V_{ref0}$ determines that the second part of the equation is the temperature dominant component. Thus the temperature coefficient of the second temperature coefficient voltage source 3 is determined by the feedback network of resistors 305 and 307 ($R_{2A}$, $R_{2B}$) and the temperature coefficient value of the input voltage at the first input 315 of the second temperature coefficient source 3, which in this embodiment is that of the first temperature coefficient voltage source output 419. The temperature coefficient for the second temperature coefficient voltage source is therefore defined by equation 4:

$$TC4 = \frac{dV_{ref4}}{dT} = A_3 \frac{R_{1B}}{R_{1A}} \frac{R_{2B}}{R_{2A}} \frac{dV_{ptat}}{dT}. \quad (4)$$

Similarly to the first temperature coefficient voltage source it is possible to define both the voltage level and also the temperature coefficient depending on the selection of the values of $A_2$ and $R_{2A}$ and $R_{2B}$. Again this may be programmed or set as required.

In a further embodiment of the present invention a second gain stage is inserted between the second temperature coefficient voltage source first input 315 and the first end of the first resistor 305.

Thus both the first and second temperature coefficient voltage sources as shown in the embodiments invert and amplify/diminish the temperature coefficient value of the voltage input on their first input with respect to the voltage coefficient on the second input (which in the present embodiment is held with a substantially zero temperature coefficient).

As can therefore be appreciated, in further embodiments of the present invention the circuit may comprise further first or second temperature coefficient voltage sources. These additional voltage sources can be used to determine further reference voltages with different voltage values and with different temperature coefficients to those generated previously. Thus in one embodiment of the present invention a series of first and second temperature coefficient voltage sources can be combined in order to produce an array of voltage sources with different temperature coefficients and different voltage levels, all determined by the network of gain stages and feedback resistor networks as explained above.

Furthermore in other embodiments of the present invention the buffer is removed thus simplifying the circuit without producing deterioration in the voltage reference value. The removal of the buffer in embodiments of the present invention can be carried out where the gain stage of the temperature coefficient voltage source has a high input impedance.

Figure 3B:
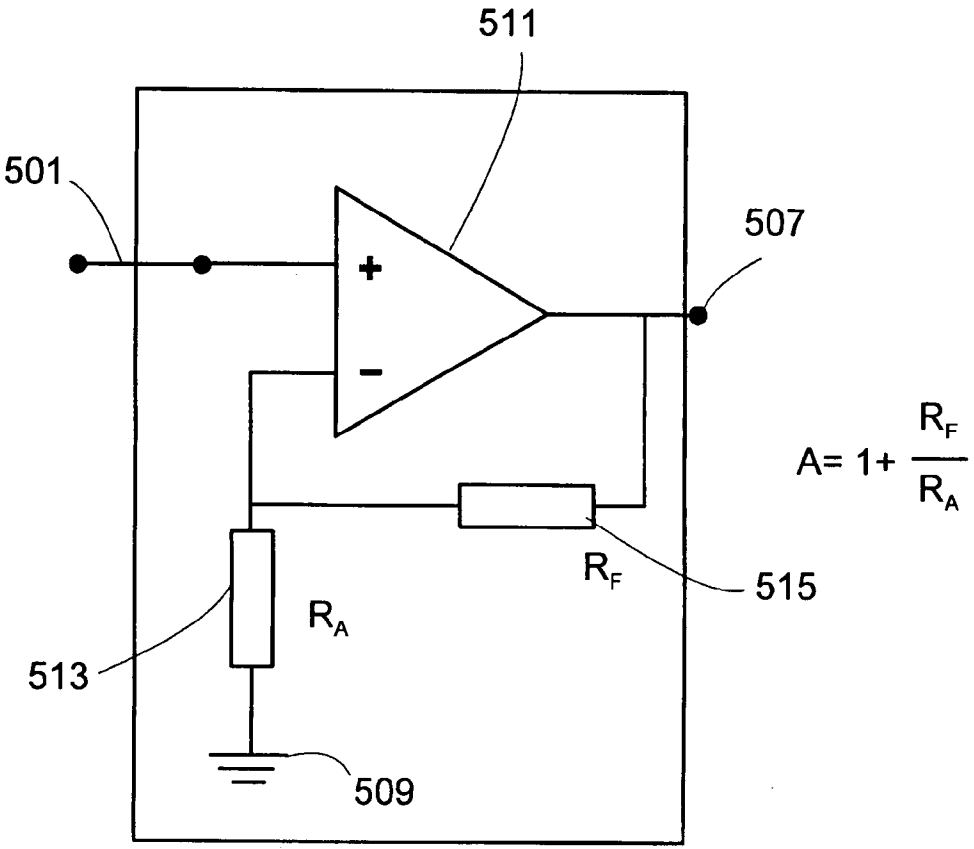
FIG. 3 shows a schematic view of two gain stages which can be used in the arrangement of FIG. 1.
Figure 3A:
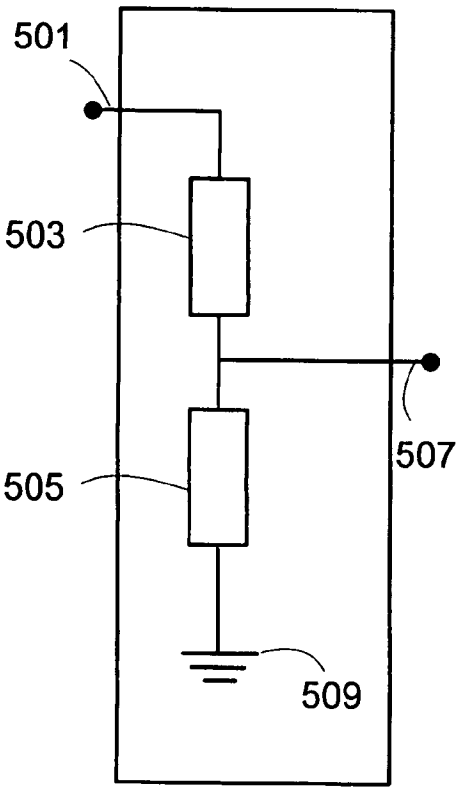

With reference to FIG. 3 two separate embodiments of a gain stage are shown. FIG. 3*a* shows a passive network, known in the art as a potential divider. As is known the input 501 is connected to a first end of a first resistor network 503 ($R_B$). The second end of the first resistor network 503 ($R_B$) is connected to the output 507, and also to a first end of a second resistor network 505 ($R_A$). The second end of the second resistor network 505 ($R_A$) is connected to a common voltage source 509. The gain of the passive network is defined by the ratio of the resistance network values as $$A = \frac{R_A}{R_A + R_B}.$$

As can be appreciated the maximum gain of such a network is always less than 1. In other words the output of the gain stage is diminished with respect to the input of the gain stage.

An alternative embodiment of the gain stage can be implemented using an active network, of which one is shown in FIG. 3*b*. FIG. 3*b* shows a gain stage using a negative feedback operational amplification configuration known as a non-inverting amplifier. The gain stage comprises an operational amplifier 511, a first resistor network 513, and a second resistor 515.

The positive input of the operational amplifier is connected to the input of the gain stage 501. The first end of the second resistor network is connected between the negative input of the operational amplifier 511 and the output of the operational amplifier 511. The second end of the second resistor network 513 is connected between the negative input of the operational amplifier 511 and a common voltage source 509. As is known in the art this type of network produces a gain defined as $$A = 1 + \frac{R_F}{R_A}.$$

In such a network the gain is always greater than 1 providing $R_F$ is greater than zero. In other words the output of the gain stage is amplified with respect to the input of the gain stage.

In further embodiments the use of the alternative voltage source generators as shown in FIGS. 2*a*, 2*b*, and 2*c*, can be used to create different embodiments of the present invention.

Connecting the alternative voltage source generator as shown in FIG. 2*a* allows the first temperature coefficient source to output a voltage source with a positive temperature coefficient. Connecting the voltage source generator 1*a* first output 111*a* ($V_{ref0}$) to the first reference voltage output 9 and the second output 113*a* ($V_{ctat}$) to the second reference output 11, determines the output source voltage and temperature coefficient as shown in equations 5 and 6.

$$V'_{ref3} = A_1\left(1 + \frac{R_{1B}}{R_{1A}}\right)V_{ref0} - A_3 \frac{R_{1B}}{R_{1A}} V_{ctat} \quad (5)$$

$$TC3' = \frac{dV'_{ref3}}{dT} = -A_3 \frac{R_{1B}}{R_{1A}} \frac{dV_{ctat}}{dT} \quad (6)$$

As the temperature coefficient $dV_{ctat}/dT$ is negative the temperature coefficient produced at the output is therefore positive.

Similarly the output 317 of the second temperature coefficient voltage source 3 is determined from the equations 7 and 8.

$$V'_{ref4} = A_2\left(1 + \frac{R_{2B}}{R_{2A}}\right)V_{ref0} - \frac{R_{2B}}{R_{2A}} V'_{ref3} \quad (7)$$

$$TC4' = \frac{dV'_{ref4}}{dT} = A_3 \frac{R_{1B}}{R_{1A}} \frac{R_{2B}}{R_{2A}} \frac{dV_{ctat}}{dT} \quad (8)$$

As the temperature coefficient $dV_{ctat}/dT$ is negative the temperature coefficient produced at the output of the second temperature coefficient voltage output 317 is positive.

The first and second voltage source embodiment based on the voltage source generator as shown in FIG. 2*b*, produces voltages and voltage temperature coefficients similar to those determined in equations 1–4. The voltage source generator 1*b* first output 111*b* is connected to the first reference output 9, and the voltage source generator 1*b* second output 113*b* is connected to the second reference output 11. The difference between being the alternative embodiment and the original embodiment being that the $V_{ptat+}$ voltage supplied to the second reference output 11 has a higher value than the $V_{ref0}$ voltage supplied to the first reference output 9.

Similarly the first and second voltage source outputs based on the voltage source generator as shown in FIG. 2*c* produce voltage and voltage temperature coefficient values similar to those determined by the complimentary to absolute temperature source as determined in equations 5–8. The voltage source generator 1*c* first output 111*c* is connected to the first reference output 9, and the voltage source generator 1*c* second output 113*c* connected to the second reference output 11. The difference between the CTAT and the CTAT+ voltages being that the $V_{ctat+}$ voltage has a higher value than the $V_{ref0}$ voltage.

Although the embodiment of the circuit described features the non-zero temperature coefficient being input to the first input of both the second and first temperature coefficient voltage sources to produce one positive and one negative coefficient voltage source, it is possible to produce either two positive or two negative coefficient voltage sources using the same circuit components but connected differently.

Therefore in a further embodiment of the present invention the first input of the second temperature coefficient voltage source is connected to the first reference voltage output 9 ($V_{ref0}$) rather than the first temperature coefficient voltage source output 419. The second input 301 is connected to the first temperature coefficient voltage source 419 rather than the first reference voltage output 9 ($V_{ref0}$). This embodiment would produce two reference voltages with two negative temperature coefficients.

In a similar way by reversing the input connections for both the second temperature coefficient voltage source 3 and the first temperature coefficient voltage source 5 two positive temperature coefficient sources are produced. In such an embodiment the first input of the second temperature coefficient voltage source is connected to the first reference voltage output 9 ($V_{ref0}$) rather than the first temperature coefficient voltage source output 419. The second input 301 is connected to the first temperature coefficient voltage source 419 rather than the first reference voltage output 9 ($V_{ref0}$). Also in such an embodiment the first input of the first temperature coefficient voltage source is connected to the first reference voltage output 9 ($V_{ref0}$) rather than the buffer output 209 (or voltage source output 11). The second input 301 of the first temperature coefficient voltage source is connected to the buffer output 209 (or voltage source output 11) rather than the first reference voltage output 9 ($V_{ref0}$). It is intended that the present invention encompass such changes and modifications as fall within the scope of the appended claims

What is claimed is:

1. A voltage reference circuit comprising:

a first reference voltage source;

a second reference voltage source, at least one of said first and second reference voltage sources being dependent on temperature;

first circuitry connected to at least one of said first and second reference voltage sources to provide a third reference voltage, said third reference voltage being dependent on temperature; and second circuitry connected to at least one of said first and second reference voltage sources to provide a fourth reference voltage, said fourth reference voltage being dependent on temperature, and wherein said third reference voltage temperature dependency is different from said fourth reference voltage temperature dependency.

2. A circuit as claimed in claim 1, wherein said at least one reference voltage source is directly proportional to temperature.

3. A circuit as claimed in claim 2, wherein said at least one reference voltage source is inversely proportional to temperature.

4. A circuit as claimed in claim 1, wherein said second circuitry comprises:

a second circuitry first input;

a second circuitry second input; and a second circuitry output, wherein said second circuitry first input is connected to said third reference voltage, said second circuitry second input is connected to said first reference voltage source and said second circuitry output provides said fourth voltage source.

5. A circuit as claimed in claim 4, wherein said second circuitry further comprises:

a first gain stage; and a differential amplifier, wherein said differential amplifier is configured to receive the output of the first gain stage and the first input and output a value to the output of said second circuitry.

6. A circuit as claimed in claim 1, wherein said first circuitry comprises:

a first input;

a second input; and an output, wherein said first input is connected to said first reference voltage source, said second input is connected to said second reference voltage source and wherein said output provides said third reference voltage.

7. A circuit as claimed in claim 6, wherein said first circuitry further comprises:

a first gain stage; and a differential amplifier, wherein said differential amplifier is configured to receive at a first input the output of the said first gain stage and output a value to the output of said first circuitry.

8. A circuit as claimed in claim 7, wherein said first circuitry further comprises a second gain stage, wherein said differential amplifier is configured to receive at a second input the output of the second gain stage.

9. A circuit as claimed in claim 1, wherein said third reference voltage temperature dependency is different from said first and second reference voltage temperature dependency.

10. A circuit as claimed in claim 1, wherein said fourth reference voltage temperature dependency is different from said first and second reference voltage temperature dependency.

11. A circuit as claimed in claim 1, wherein said first reference voltage source is independent of temperature.

12. A circuit as claimed in claim 1, wherein said third reference voltage temperature dependency is one of a positive or negative temperature dependency.

13. A circuit as claimed in claim 1, wherein said fourth reference voltage temperature dependency is one of a positive or negative temperature dependency.

14. A circuit as claimed in claim 1, wherein said third reference voltage is dependent on at least one of:

said first reference voltage;

said second reference voltage; and said first circuitry.

15. A circuit as claimed in claim 1, wherein said fourth reference voltage is dependent on at least one of:

said first reference voltage;

said third reference voltage; and said second circuitry.

16. A circuit as claimed in claim 1, wherein said circuit is arranged such that at least one of:

said third and fourth reference voltages is controllable to have at least one required characteristic.

17. A circuit as claimed in claim 16, wherein at least one of said third and fourth reference voltage is selected to have a required characteristic by controlling at least one of:

said first reference voltage;

said second reference voltage;

said third reference voltage;

said first circuitry and said second circuitry.

18. An integrated circuit comprising a circuit as claimed in claim 1.

19. A method for providing reference voltages comprising the steps of:

providing a first reference voltage;

providing a second reference voltage at least one of which being dependent on temperature;

providing a third reference voltage from a first circuitry connected to at least one of said first and second reference voltage sources, said third reference voltage being dependent on temperature; and providing a fourth reference voltage from a second circuitry connected to at least one of said first and second reference voltage sources, said fourth reference voltage being dependent on temperature; wherein said third reference voltage temperature is different from said fourth reference voltage temperature dependency.

20. A voltage reference circuit comprising:

at least two reference voltage sources;

first circuitry connected to at least one of said two reference voltage sources to provide a third reference voltage which is dependent on temperature; and second circuitry connected to at least one of said two reference voltage sources to provide a fourth reference voltage which is dependent on temperature, said fourth reference voltage temperature dependency being different from said third reference voltage temperature dependency.

21. A circuit as set forth in claim 20 wherein at least one of said two reference voltage sources being dependent on temperature.

22. A circuit as claimed in claim 20, wherein at least one of said two reference voltage sources is directly proportional to temperature.

23. A circuit as claimed in claim 22, wherein at least one of said two reference voltage sources is inversely proportional to temperature.

* * * * *